US006029570A

United States Patent [19]

Matuschczyk

[11] Patent Number: 6,029,570

[45] Date of Patent: Feb. 29, 2000

[54] PRESS JACKET FOR A PRESS DEVICE

[75] Inventor: Uwe Matuschczyk, Geislingen, Germany

[73] Assignee: Voith Sulzer Papiermaschinen GmbH, Heidenheim, Germany

[21] Appl. No.: 09/084,901

[22] Filed: May 28, 1998

[30] Foreign Application Priority Data

May 30, 1997 [DE] Germany ..... 197 22 638

[51] Int. Cl.[7] ..... B30B 9/20

[52] U.S. Cl. ..... 100/121; 162/358.1; 492/31; 492/33; 492/35

[58] Field of Search ..... 100/118, 121; 34/70, 113, 120, 127; 162/358.1, 358.2, 358.3, 372; 492/31–33, 35

[56] References Cited

U.S. PATENT DOCUMENTS

| | | | |
|---|---|---|---|
| 1,805,780 | 5/1931 | Millspaugh | 492/31 |
| 3,562,883 | 2/1971 | Kobayashi | 492/33 |
| 4,207,998 | 6/1980 | Schmid | 492/31 |
| 4,366,025 | 12/1982 | Gordon, Jr. et al. | 100/118 |

FOREIGN PATENT DOCUMENTS

| | | | |
|---|---|---|---|
| 0282887 | 9/1989 | European Pat. Off. | 100/121 |
| 2621618 | 4/1989 | France | 100/121 |
| 2630465 | 10/1989 | France | 100/121 |
| 3715153 | 12/1988 | Germany . | |
| 4237091 | 5/1993 | Germany . | |
| 4401580 | 6/1994 | Germany . | |
| 4411621 | 10/1995 | Germany . | |

OTHER PUBLICATIONS

Hessler, "Derzeitiger Stand und Perspektiven für die Zukunft bei Walzenbezügen im Tissuebereich," *Wochenblatt für Papier–fabrikation,* No. 17, pp. 771–778, (1989).

*Primary Examiner*—Stephen F. Gerrity
*Attorney, Agent, or Firm*—Greenblm & Berstein, P.L.C.

[57] ABSTRACT

Press jacket for a press device that drains a material web in a press nip having a press nip length. The press jacket includes blind holes for water absorption that open to a jacket surface of the press jacket and channels extending at least sectionally in a web run direction being coupled to the blind holes. The channels have a length in the web run direction greater than a length of the press nip.

32 Claims, 2 Drawing Sheets

PRESS JACKET FOR A PRESS DEVICE

CROSS-REFERENCE TO RELATED APPLICATIONS

The present application claims priority under 35 U.S.C. § 119 of German Patent Application No. 197 22 638.8, filed on May 30, 1998, the disclosure of which is expressly incorporated by reference herein in its entirety.

BACKGROUND OF THE INVENTION

1. Field of the Invention

The present invention relates to a press jacket of a press device for draining a material web in a press nip (opening), e.g., a paper web in a shoe press. The press jacket includes, at least in the press region, blind holes for water absorption (containing) that open outwardly to a surface of the press jacket, and are oriented toward the press nip.

2. Discussion of Background Information

It is known to increase drying performance of a press by providing blind holes in press jackets for shoe presses for the absorption of water. It is likewise known to increase the drying performance with grooves in the surface of the press jackets.

Although blind holes have a greater storage volume than grooves, they have the disadvantage that a greater hydraulic pressure is built up in the press nip. This disadvantage does not occur with grooves which provide only a lower water storage volume.

SUMMARY OF THE INVENTION

The present invention provides a press jacket of the type generally discussed above, in which a high water storage volume and a low hydraulic pressure occurs in the press nip.

The present invention provides blind holes that are coupled, at least sectionally, to grooves extending in a web run direction. The length of the grooves in web run direction is greater than the length of the press nip.

As discussed above, the blind holes guarantee a high water storage volume. By coupling the blind holes to grooves that extend in a web run direction for a length greater than the length of the press nip, the hydraulic pressure in the press nip is reduced due to the coupling of the blind holes to grooves in sections prior to and subsequent to the press nip, whereby they are connected to atmospheric pressure. Moreover, the water absorbed in the blind holes can partially run off through the grooves, thus, preventing a build up of a large hydraulic pressure in the blind holes.

It is generally sufficient to provide grooves having a length greater than a length of the press nip. In this manner, blind holes are always coupled to atmospheric pressure. Moreover, the grooves may be formed as grooves extending over an entire length of the press jacket, i.e., with respect to a web run direction, and, in particular, may be formed as continuous grooves. This particular arrangement is simple to manufacture and enables a simultaneous connection of several subsequently disposed blind holes to the atmospheric pressure.

In accordance with another embodiment of the invention, the grooves may be positioned in a helical line around the press jacket. The grooves may thereby form either a simple (single), a double, or multiple helical line. Helical line grooves are generally easy to manufacture and also improve the characteristics of the roll jacket.

In accordance with a further embodiment of the invention, the blind holes may be uniformly distributed across the surface of the jacket. In this manner, uniform draining of the web may be obtained.

The spacing between adjacent blind holes among may be substantially equal. For example, the spacing of adjacent blind holes should not deviate more than approximately 10% from one another. As a result, draining performance may be particularly good and uniform.

In accordance with an alternative embodiment of the present invention, the channels or groove slots may be arranged to run substantially parallel to one another. At the same time, the spacing and width of the channels or grooves may be substantially equal among each other. Further, the uniformity of the arrangement of the grooves or the channels increases the uniformity of the draining, while also simplifying manufacturing.

An edge-to-edge spacing of adjacent channels or grooves is preferably less than or equal to a diameter of the blind holes. In this manner, it is guaranteed that each blind hole will be coupled to at least one groove or channel.

In addition, a width of the channels or grooves may be, e.g., less than or equal to a diameter of the blind holes. The blind holes advantageously form the main storage volume for water absorption, enabling the width of the channels or grooves to be kept small, to provide the hydraulic pressure reduction. An absorption of water from the paper web through the channels or grooves is generally unnecessary, so that the channels or grooves can be formed with a very narrow width.

In accordance with a further embodiment of the present invention, the depth of the blind holes may be greater than a depth for the channels or grooves coupled to the blind holes. The particular embodiment is made possible due to the main storage volume being formed by the blind holes. Thus, with the channels or grooves being formed with a lesser depth, and with the blind holes formed to enable a sufficient amount of water can run out of the blind holes of the press nip region, high hydraulic pressure is avoided. As a result, a sturdiness of the press jacket is increased and the danger of rupture or tear formations is decreased.

In accordance with another embodiment of the present invention, the blind holes may be arranged along lines that are oriented at a lead angle $\beta_B$ to the web run direction, which may be, e.g., between approximately 5° and 15°. An arrangement of the blind holes such as this has proven particularly advantageous in draining. In particular, the stability of the press jacket is impaired comparatively little and the danger of the proliferation of tears in web run direction is reduced.

In accordance with a further embodiment of the present invention, the channels or grooves may be oriented at a lead angle $\alpha_R$ that may correspond with lead angle $\beta_B$ of the blind holes. In particular, the channels or grooves are arranged such that the lines, which follow the blind holes and the channels or grooves, coincide. An arrangement may be that the channels or grooves are coupled through the centers of the blind holes. In this manner, water diversion is hereby optimal and the press jacket stability likewise good.

In accordance with another embodiment of the present invention, the channels or grooves follow a line oriented at a lead angle $\alpha_R$ which may be, e.g., between about 0.1° and 3°. This embodiment, in which the channels or grooves are oriented to run at a different lead angle than the blind holes, has proven advantageous. In this manner, the connection of the channels or grooves to the blind holes varies over the press jacket.

The open surface of the roll jacket in the press area may amount to, e.g., more than 30% of the entire surface of the press jacket in this area. In this manner, a high drainage capacity is advantageously achieved.

In accordance with another embodiment of the present invention, the blind holes may provided with one of at least two different diameters. The blind holes having different diameters may be arranged in equal distribution over the surface of the press jacket, e.g., blind holes having a larger diameter may be staggered with blind holes having a smaller diameter. An increase of the water absorption is obtained without exaggerated reduction of the passages between the blind holes and thereby without a stability damage which is all too great.

Accordingly, the present invention is directed to a press jacket for a press device that drains a material web in a press nip having a press nip length. The press jacket includes blind holes for water absorption that open to a jacket surface of the press jacket and channels extending at least sectionally in a web run direction being coupled to the blind holes. The channels have a length in the web run direction greater than a length of the press nip.

In accordance with another feature of the present invention, the channels are formed as grooves that extend over an entire length of the press jacket with respect to the web run direction. Further, the grooves may be formed as continuous grooves. Alternatively, the grooves may be arranged to form a helical line. Still further, the grooves may be arranged to form one of a double helical line and a multiple helical line.

In accordance with another feature of the present invention, the blind holes may be substantially equally distributed over the jacket surface. Further, adjacently distributed blind holes may be substantially equally spaced from each other. Still further, the substantially equal spacing between adjacently distributed blind holes does not deviate by more than about 10%.

In accordance with still another feature of the present invention, the channels may be arranged to run parallel to each other.

In accordance with another feature of the present invention, the channels may be arranged to provide distances between the channels that is substantially equal and widths of the channels are substantially the same. Further, the distances between channels is less than or equal to a diameter of the blind holes. Further still, the distance between channels may be determined from edge to edge. Alternatively, the widths of the channels is less than or equal to a diameter of the blind holes.

In accordance with a further feature of the present invention, the blind holes may have a hole depth and the channels having a channel depth and the hole depth may be greater than the channel depth.

In accordance with another feature of the present invention, the blind holes may be aligned and oriented at an angle $\beta_B$ to the web run direction greater than 0°. Angle $\beta_B$ may be between approximately 5° and 15°. Further, the channels may be oriented at an angle $\alpha_R$, which substantially corresponds to angle $\beta_B$. Still further, the blind holes and the channels may be aligned.

In accordance with a still further feature of the present invention, the channels may be aligned and oriented at an angle $\alpha_R$ between approximately 0.1° and 3°.

In accordance with another feature of the present invention, an open surface of the roll jacket within the press nip may be composed of more than approximately 30% of the entire surface within the press nip.

In accordance with still another feature of the present invention, the blind holes may be composed of blind holes with at least two different diameters. Further, the blind holes with at least two different diameters may be arranged in a uniform distribution over the roll jacket surface.

The present invention is also directed to a press jacket adapted for movement in a run direction of a press device. The press jacket includes blind holes coupled to a jacket surface of the press jacket, and at least one channel coupled to the blind holes and the jacket surface. The channels are oriented at an angle to the run direction.

In accordance with another feature of the present invention, the at least one channel may be composed of at least one helical groove extending across a length of the roll jacket.

In accordance with another feature of the present invention, the at least one channel may be composed of a plurality of continuous grooves disposed parallel to each other across a length of the roll jacket.

In accordance with still another feature of the present invention, the blind holes may be arranged such that adjacent blind holes are substantially a same distance apart.

In accordance with a further feature of the present invention, the blind holes having centers, and the blind holes may be arranged so that the at least one channel extends through the centers.

In accordance with a further feature of the present invention, the blind holes having diameters, and the at least one channel forming a surface segment having a width less than or equal to the diameters of the blind holes.

In accordance with still another feature of the present invention, the at least one blind hole is composed of blind holes aligned at an angle to the run direction, and the angle of the blind holes may be substantially the same as the angle of the at least one channel. Further, the angle of the blind holes and the angle of the at least one channel to the run direction may be between approximately 5° and 15°.

In accordance with yet another feature of the present invention, the at least one blind hole is composed of blind holes aligned at an angle to the run direction, and the angle of the blind holes may be different than the angle of the at least one channel. Further, the angle of the at least one channel is between approximately 0.1° and 0.3°, and the angle of the blind holes is between approximately 5° and 15°.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
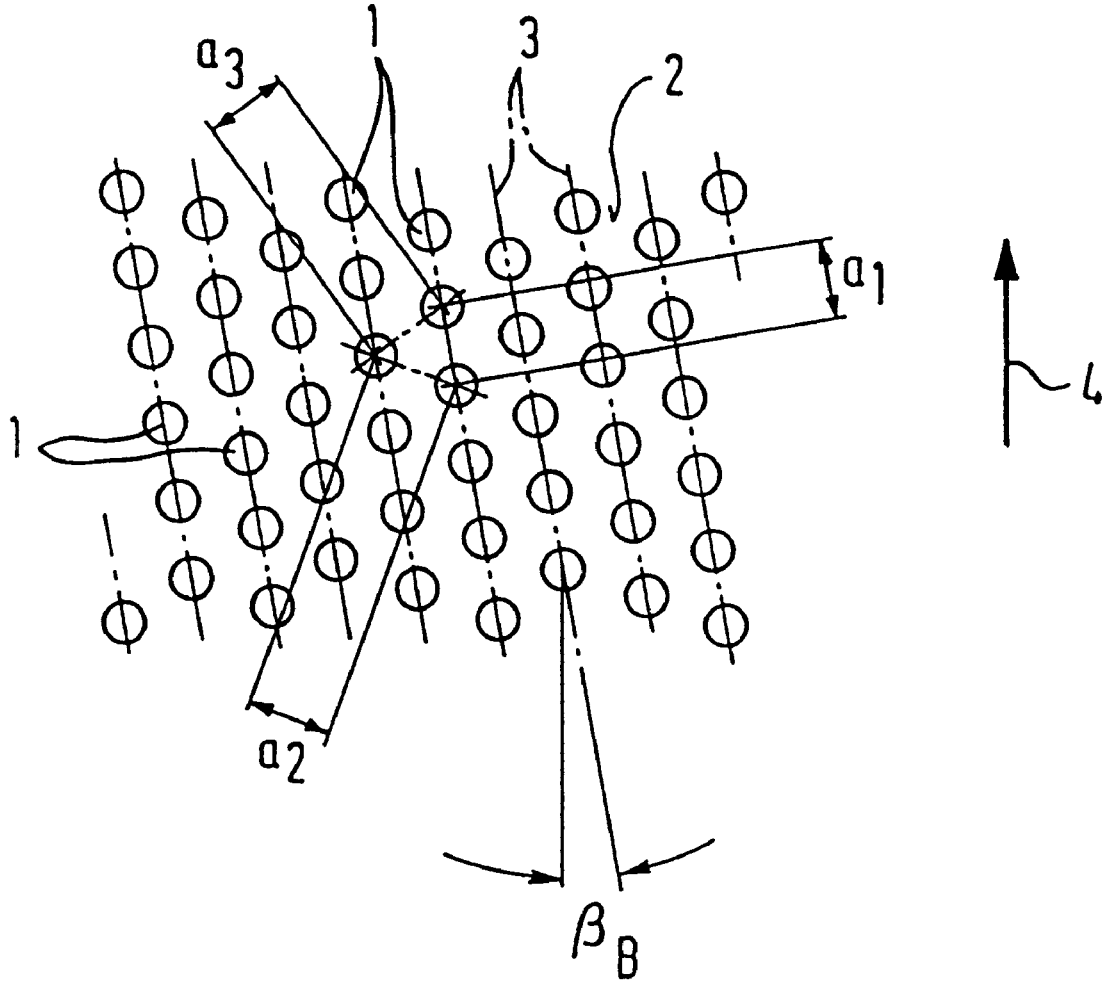
FIG. 1 illustrates an arrangement of the blind holes of a press jacket in accordance with the features of the present invention.

As illustrated in FIG. 1, blind holes 1 may be formed in an outer surface of a press jacket, and may be distributed or arranged uniformly over surface 2 of the press jacket. In particular, blind holes 1 may have a substantially equal spacing $a_1$, $a_2$, $a_3$, respectively, between adjacent blind holes 1, and a deviation of the substantially equal distances $a_1$–$a_3$ may be, e.g., approximately 10% or less.

As depicted in FIG. 1, blind holes 1 may be arranged along lines 3, which may be oriented at an angle $\beta_B$ to a web run direction 4. Angle $\beta_B$ may be, e.g., between approximately 5° and 15° . The channels or grooves interconnecting blind holes 1 are specifically depicted in FIG. 1.

Figure 2:
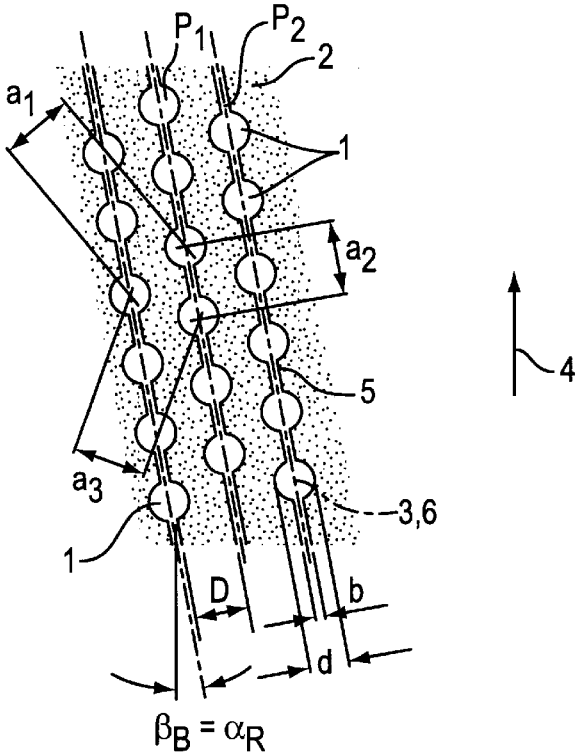
FIG. 2 illustrates a plan view of a portion of an alternative embodiment of the press jacket according to the features of the present invention.

FIG. 2 illustrates an embodiment of the press jacket in accordance with the present invention, in which blind holes 1 are arranged along lines 3 oriented at an angle of, e.g., between approximately 5° and 15° to web run direction 4. In addition to blind holes 1, grooves 5 may be formed in the surface 2 of the press jacket to extend along lines 6 oriented at an angle $\alpha_R$ to web run direction 4. Angle $\alpha_R$ may be, e.g., between approximately 5° and 15° with the web run direction 4. Further, as illustrated in FIG. 2, lines 6 may coincide with lines 3 so that grooves 5 are positioned to extend through the centers of blind holes 1.

As depicted in FIG. 2, a substantially equal distance D may be provided between grooves 5 on surface 2 of the press jacket, and each groove 5 may be formed with a width b that is less than a diameter d of blind holes 1. As shown, blind holes 1 are also arranged so that substantially equal distances $a_1$, $a_2$, and $a_3$ are provided between adjacent blind holes 1.

Figure 3:
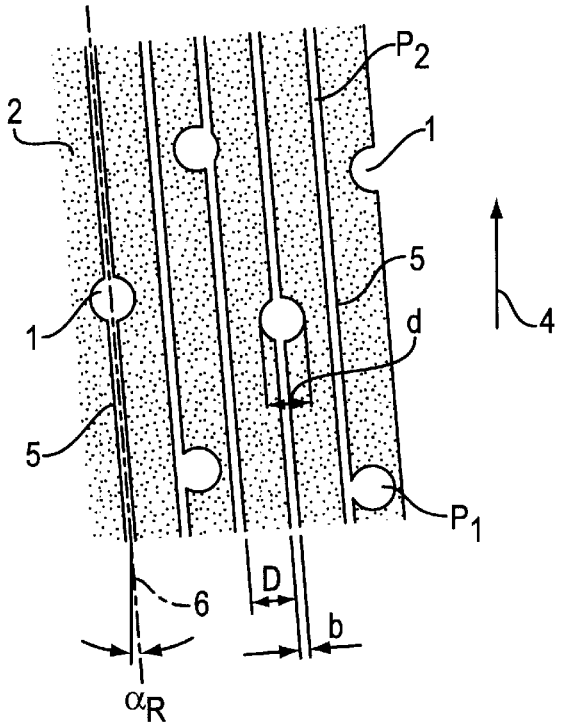
FIG. 3 illustrates a plan view of a portion of an alternative embodiment of the press jacket according to the features of the present invention.

In an alternative embodiment of the press jacket of the present invention, FIG. 3 illustrates grooves 5 that arranged substantially parallel to each other at distance D. Distance D between the edges of adjacent grooves 5 may be substantially equal to or less than diameter d of blind holes 1. Although blind holes 1 are not arranged to align with line 6, as was the case in FIG. 2, because the diameter of blind holes 1 is at least as great as the distance between grooves 5, this particular embodiment ensures that every blind hole 1 will be coupled to at least one groove 5.

In each of the depicted embodiments, grooves 5 may be formed, e.g., as continuous grooves or as helical line grooves. Grooves 5 may also form a double or multiple helical line. Blind holes 1 may be either distributed uniformly or randomly distributed over surface 2 of the press jacket. The depth $p_1$ of blind holes 1 may be preferably larger than a depth $p_2$ of grooves 5. As illustrated in FIG. 3, grooves 5 may also be oriented at a small angle $\alpha_R$ to a peripheral (web run direction) direction 4. Angle $\alpha_R$ may be, e.g., between approximately 0.1° and 0.3°. In accordance with the features of the present invention, it is preferred that, of the entire face portion of the press jacket located within the nip, an open face portion formed by blind holes 1 and grooves 5 is more than 30% of the entire face portion.

In this manner, a press jacket having very good drying characteristic results due to very good water absorption and water diversion. More particularly, blind holes 1 provide for a large storage volume and grooves 5 provide for a diversion of the water from the press nip. In this manner, the press jacket of the present invention avoids the establishment of a high hydraulic pressure in the press nip. Further, the press jacket of the present invention provides high stability, while providing for comparatively simple manufacture.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

Reference List

1. Blind hole
2. Press jacket surface
3. Line
4. Web run direction
5. Channel or groove
6. Line
b. Width of channel
d. Diameter of blind hole
D. Distance of adjacent channels or grooves
$a_1$ Blind hole spacing
$a_2$ Blind hole spacing
$a_3$ Blind hole spacing
$p_1$ Blind hole depth
$p_2$ Groove depth

What is claimed is:

1. A press jacket for a press device that drains a material web in a press nip having a press nip length comprising:

blind holes for water absorption that open to a jacket surface of the press jacket;

channels extending at least sectionally in a web run direction being coupled to the blind holes; and the channels having a length in the web run direction greater than a length of the press nip, the channels being aligned and oriented at an angle between approximately 0.1° and 3°.

2. The press jacket in accordance with claim 1, the channels being formed as grooves that extend over an entire length of the press jacket with respect to the web run direction.

3. The press jacket in accordance with claim 2, the grooves being formed as continuous grooves.

4. The press jacket in accordance with claim 2, the grooves being arranged to form a helical line.

5. The press jacket in accordance with claim 4, the grooves being arranged to form one of a double helical line and a multiple helical line.

6. The press jacket in accordance with claim 1, the blind holes being substantially equally distributed over the jacket surface.

7. The press jacket in accordance with claim 6, adjacently distributed blind holes being substantially equally spaced from each other.

8. The press jacket in accordance with claim 7, the substantially equal spacing between adjacently distributed blind holes does not deviate by more than about 10%.

9. The press jacket in accordance with claim 1, the channels being arranged to run parallel to each other.

10. The press jacket in accordance with claim 1, the channels being arranged to provide distances between the channels that are substantially equal and widths of the channels are substantially the same.

11. The press jacket in accordance with claim 10, the distances between channels are less than or equal to a diameter of the blind holes.

12. The press jacket in accordance with claim 11, the distance between channels being determined from edge to edge.

13. The press jacket in accordance with claim 10, the widths of the channels are less than or equal to a diameter of the blind holes.

14. The press jacket in accordance with claim 1, the blind holes having a hole depth and the channels having a channel depth; and the hole depth being greater than the channel depth.

15. The press jacket in accordance with claim 1, the blind holes being aligned and oriented at an angle $\beta_B$ to the web run direction greater than 0°.

16. The press jacket in accordance with claim 15, angle $\beta_B$ being between approximately 5° and 15°.

17. The press jacket in accordance with claim 15, the channels being oriented at an angle $\alpha_R$, which substantially corresponds to angle $\beta_B$.

18. The press jacket in accordance with claim 17, the blind holes and the channels being aligned.

19. The press jacket in accordance with claim 1, the surface of the roll jacket within the press nip including more than approximately 30% open surface.

20. The press jacket in accordance with claim 1, the blind holes being composed of blind holes with at least two different diameters.

21. The press jacket in accordance with claim 20, the blind holes with at least two different diameters being arranged in a uniform distribution over the roll jacket surface.

22. A press jacket adapted for movement in a run direction of a press device comprising:

blind holes for water absorption coupled to a jacket surface of the press jacket, the blind holes being aligned at an angle to the run direction;

at least one channel coupled to the blind holes and the jacket surface, said at least one channel extending at least sectionally in a web run direction; and the channels being oriented at an angle between approximately 0.1° and 3° to the run direction, the angle of the blind holes being different than the angle of the channels, and the channels having a length in the web run direction greater than a length of the press nip.

23. The press jacket in accordance with claim 22, the at least one channel being composed of at least one helical groove extending across a length of the roll jacket.

24. The press jacket in accordance with claim 22, the at least one channel being composed of a plurality of continuous grooves disposed parallel to each other across a length of the roll jacket.

25. The press jacket in accordance with claim 22, the blind holes being arranged such that adjacent blind holes are substantially a same distance apart.

26. The press jacket in accordance with claim 22, the blind holes having centers; and the blind holes being arranged so that the at least one channel extends through the centers.

27. The press jacket in accordance with claim 22, the blind holes having diameters; and the at least one channel forming a surface segment having a width less than or equal to the diameters of the blind holes.

28. The press jacket in accordance with claim 22, the at least one blind hole being composed of blind holes aligned at an angle to the run direction; and the angle of the blind holes being substantially the same as the angle of the at least one channel.

29. The press jacket in accordance with claim 28, the angle of the blind holes and the angle of the at least one channel to the run direction is between approximately 5° and 15°.

30. The press jacket in accordance with claim 22, the angle of the at least one channel being between approximately 0.1° and 0.3°.

31. The press jacket in accordance with claim 22, the angle of the blind holes being between approximately 5° and 15°.

32. The press jacket in accordance with claim 31, the angle of the at least one channel being between approximately 0.1° and 0.3°.

* * * * *